United States Patent [19]

Gulla et al.

[11] 4,152,164

[45] May 1, 1979

[54] ELECTROLESS NICKEL PLATING

[76] Inventors: Michael Gulla, 24 Ivy La., Sherborn, Mass. 01770; Charles R. Shipley, Jr., 71 Vista Ave., Newton, Mass. 02166; Howard A. MacKay, 17 Ardell St., Quincy, Mass. 02171

[21] Appl. No.: 734,486

[22] Filed: Oct. 21, 1976

Related U.S. Application Data

[62] Division of Ser. No. 680,188, Apr. 26, 1976.

[51] Int. Cl.[2] ..... C23C 3/02

[52] U.S. Cl. ..... 106/1.27; 427/438

[58] Field of Search ..... 106/1, 1.22, 1.23, 1.27; 427/304, 305, 306, 437, 438

[56] References Cited

U.S. PATENT DOCUMENTS

| | | | |
|---|---|---|---|
| 2,872,354 | 2/1959 | Lee | 427/428 |
| 3,805,023 | 4/1974 | Wainer et al. | 106/1 |
| 3,832,168 | 8/1974 | Gulla | 75/170 |
| 3,876,434 | 4/1975 | Dutkewych et al. | 427/437 |

*Primary Examiner*—Lorenzo B. Hayes
*Assistant Examiner*—Amelia B. Yarbrough

[57] ABSTRACT

This invention relates to electroless metal deposition and more specifically, to a process where a plating solution is brought to equilibrium and thereafter operated with the concentration of plating reactants and by-products maintained substantially constant. The plating solution treated in accordance with the invention is one having evaporative losses of at least one percent per plating cycle. Following the process, a plating solution can be operated indefinitely and yields a metal plate of uniform quality and predictable properties at any time during use of the solution. The invention avoids the known problems of by-product build-up and variable concentration of reactants typically associated with the use of such solutions.

9 Claims, No Drawings

ELECTROLESS NICKEL PLATING

This is a division of application Ser. No. 680,188 filed Apr. 26, 1976.

BACKGROUND OF THE INVENTION

1. Field of the Invention

This invention relates to electroless metal plating and more particularly, to a method for operation of an electroless metal plating solution having evaporative losses of at least one percent per plating cycle.

2. Description of the Prior Art

Electroless metal deposition refers to the chemical plating of a metal such as nickel, cobalt and the like over an active surface by chemical reduction in the absence of external electric current. Processes and compositions useful therefor are described in numerous publications including, for example, U.S. Pat. Nos. 3,123,484; 3,148,072; 3,338,726; 3,719,508; 3,745,039; 3,754,939 and 3,915,717 (example 8) all included herein by reference.

Known electroless deposition solutions generally comprise at least four ingredients dissolved in a solvent, typically water. They are (1) a source of metal ions, (2) a reducing agent such as hypophosphite, an amine borane, or a borohydride, (3) an acid or hydroxide pH adjustor to provide required solution pH and (4) a complexing agent for the metal ions sufficient to prevent their precipitation from solution. Other minor additives include stabilizers, brighteners, alloying agents, surfactants and the like as is known in the art.

In general, metal deposition involves the reduction of metallic ions to metallic form by the action of a reducing agent, typically the borane, borohydride or the hypophosphite ion or the reaction product of the hypophosphite ion with water. Using hypophosphite as the reducing agent, a metal deposit is a phosphorus alloy.

The deposition or reduction reaction is initiated by contact with a catalytic surface such as a catalytic metal work-piece or a catalyzed non-conductor. Once initiated, deposition is autocatalyzed by the metal placed onto the surface of the work-piece. The deposition reaction, using a nickel-hypophosphite plating bath for illustration, can be represented by the following reaction:

$$2(H_2PO_2)^- + 2HOH + Ni^{++} \xrightarrow[\text{surf}]{\text{cat}}$$

$$2(H_2PO_3)^- + Ni^\circ + 2H_2$$

The above equation can be rewritten for specific reactants, using nickel sulphate and sodium hypophospite as exemplary reactants, as follows:

$$2Na(H_2PO_2) + 2HOH + NiSO_4 \xrightarrow[\text{surf}]{\text{cat}}$$

$$2NaH(H_2PO_3) + Ni + H_2SO_4 + H_2$$

The deposition reaction for an amine borane using dimethylamine borane and nickel chloride for purposes of illustration is set forth below:

$$(CH_3)_2\,HNBH_3 + 3HOH + NiCl_2 \xrightarrow[\text{surf}]{\text{cat}}$$

$$(CH_3)_2HN + H_3BO_3 + 2H_2 + 2HCl + Ni^\circ$$

From the above equations, it should be evident that the composition of a plating solution changes continuously throughout a plating reaction. For example, in the above reaction, nickel is depleted by plate-out onto a work-piece, reducing agent is consumed by oxidation — i.e., sodium hypophosphite is oxidized to sodium dihydrogen phosphite and possibly, some sodium hypophosphate and the anion of the nickel salt forms an acid with hydrogen liberated during the plating reaction. Thus, throughout the above plating process, nickel concentration decreases from its initial concentration, oxidation products and acid concentrations increase and pH changes as acid is formed. These compositional alterations eventually cause change in the quality and uniformity of a metal plate as well as in plating rate.

The art, well aware of the aforesaid compositional variation taking place during plating, has attempted to compensate for the same by frequent replenishment of bath constituents such as by replenishment with metal salts, reducing agents and pH adjusters. Other replenisher constituents may be added such as complexing agents, stabilizers, and the like, even though these materials are usually non-reactive. Replenishment of these materials is needed to compensate for losses due to drag-out, consumption and the like.

Replenishment is accomplished to periodic addition of either dry replenisher components or concentrated aqueous solutions thereof so that the concentration of each component is returned to substantially its initial concentration. The replenisher may be admixed prior to addition or added separately. Aqueous solutions are preferably used for replenishment as the addition of dry powders can trigger the plating bath if careful control is not exercised.

Notwithstanding the above replenishment practices, difficulties in the quality and uniformity of the metal plate, and changes in plating rate are encountered. The difficulties are, to a large extent, due to continual build-up of reaction by-products as plating proceeds. Thus, though initially zero, there is a gradual, but steady increase in the concentrations of by-products as well as salts formed by neutralizing acid formed during reaction. Though the prior art replaces depleted constituents through replenishment, no provision is made for removal of by-products continuously during use.

By-product content is not a serious problem through the first several cycles of plating (as defined hereinafter) because the concentration of by-products is initially low. However, dependent upon the substrate plated, the initial concentration of the metal ions in solution, and the pre-treatment of the substrate, by-products become troublesome as plating proceeds. For example, when plating an active substrate such as aluminum with a nickel plating solution containing about seven or more grams of nickel as metal, solution by-products are a serious problem of the third or fourth plating cycle. For less active substrates, such as catalyzed plastic or non-active metals such as mild steel, by-products are a serious problem by about the 6th to 8th cycle. As a consequence, an electroless solution is frequently dumped after from about 3 to 10 plating cycles thus requiring shutdown of the plating line for preparation of fresh solution resulting in lost time and costs known to be associated with shutdowns and disposal of used solutions.

DEFINITION OF TERMS

The following definitions will be of assistance in understanding the discussion of the invention.

"By-Products" are materials formed in the plating solution as a consequence of plating. They comprise, for example, the phosphite when hypophosphite is used as a reducing agent or amine and acid where amine boranes are used as a reducing agent and the salt formed by neutralization of acid generated during plating. By-products result both from the initial plating solution and from constituents added by replenishment.

"Reactants" are those constituents of the plating plating solution which are consumed during the reaction whereby the metal plate is formed. Such materials comprise, for example, the metal ions and reducing agent.

"Supplemental Components" are those components in the plating solution which do not directly produce by-products. Examples include complexing agents, stabilizers, brighteners, surfactants and the like.

"Replenishers" comprise any one or more of the reactants and supplemental components whether added to the plating solution in admixture or separately and whether added in liquid or dry form.

"Plating Cycle" means operation of a plating solution for a time sufficient to deposit all of the metal originally present in the plating solution.

"Equilibrium" for any given by-product is that point in the plating process where the concentration of the by-product in solution has reached 90% of a true equilibrium concentration. True equilibrium is not used for purposes set forth herein as the time necessary to reach true equilibrium is infinite.

STATEMENT OF THE INVENTION

In accordance with this invention, a metal plating solution experiencing evaporative losses of at least one percent per plating cycle is capable of infinite operation without requiring shut-down nor bulk disposal of the solution provided the same is not otherwise contaminated by extraneous materials. The process of the invention comprises operation of the plating solution such, that in each plating cycle, volume is maintained constant, a portion of the solution is continuously or periodically withdrawn, and the solution is replenished, the process preferably being operated in the sequence of steps given though it being understood that the sequence can be changed with less efficient operation. Operation of the solution in this manner results in withdrawal of a portion of solution by-products during each plating cycle thus preventing by-product concentration from reaching an intolerable level. Instead, by-product concentration reaches an equilibrium level which level may be predetermined by the volume of the solution withdrawn each plating cycle.

The invention also contemplates replenisher compositions which compositions differ from those of the prior art in that they are formulated to replenish solution constituents lost by reaction and drag-out and in addition, constituents lost by withdrawal of solution. Moreover, the replenishers can be formulated such that at some point in the plating of a part, an extraneous constituent may be added to the plating solution such as an alloying agent, for example, copper, to obtain a laminar depoist. For example, copper ions in a nickel plating solution can improve appearance and corrosion resistance. Hence, copper ions may be added by replenishment during the latter stages of plating a part to obtain an aesthetically pleasing surface or a corrosive resistant top or bottom layer. Because of withdrawal of solution in accordance with the invention, the copper content will be rapidly depleted and subsequent parts will not have an alloy deposit unless there is separate replenishment of an alloying constituent.

DESCRIPTION OF THE PREFERRED EMBODIMENTS

In accordance with a preferred embodiment of the invention, a plating solution is operated from start-up as if it were at equilibrium. In accordance with this embodiment, from the beginning of operation, the total volume of solution is maintained constant, preferably by addition of water, a portion of the solution is withdrawn, and the solution is replenished. The sequence of steps, in the order given, is most preferred for ease and economy of operation though the given sequence is not mandatory. For example, volume maintenance and replenishment may be done simultane usly with replenisher solution diluted sufficiently to provide the necessary volume. This is a lesser preferred embodiment because fresh replenisher will be withdrawn if solution is withdrawn immediately following replenishment. As a further alternative, the operation may be carried out on a continuous basis where volume is maintained by metering water into the tank, replenisher is metered into the tank on a continuous basis and solution is withdrawn continuously.

The total volume of liquid added to the plating solution is that amount lost by evaporation and that withdrawn less the volume added with the replenishers.

The solution withdrawn may be dumped, treated to remove by-products, treated to recover all constituents or preferably used as a second stand-by or replacement plating solution. The amount of solution withdrawn can vary within broad parameters dependent upon the concentration of the components in the bath and the tolerable concentration of by-product at equilibrium conditions. Preferably, the volume of solution withdrawn is from about 1% to 60% by volume of the total volume of plating solution per plating cycle and usually varies between 5 and 25% of the solution volume. Higher volumes of solution withdrawal assures safe operation of the plating solution, as larger quantities of by-products are withdrawn, and the solution comes to equilibrium rapidly and contains a relatively low concentration of by-products at equilibrium. However, removal of large volumes is uneconomical and hence, undesirable.

As earlier described, if by-products were permitted to increase in concentration without removal, their concentration would reach a level where the plating solution would no longer be suitable for use within about 3 to 10 plating cycles, dependent upon the work plated. As a guideline only, the volume of liquid withdrawn per cycle may be conveniently equated to the total volume of plating solution divided by the estimated number of cycles the solution could be used if by-products were not withdrawn. For example, using a typical electroless nickel solution to plate a mild steel substrate, dependent upon the pre-treatment employed, it is estimated that the solution could be used for about 7 cycles before disposal became necessary. Accordingly, while maintaining volume constant, approximatel: 14% of the volume of solution should be withdrawn per cycle with replenishers added to replace solution constituents removed. Following these procedures, the plating solution may be used indefinitely and plating quality will be uniform at any time during use of the solution.

By operation of the solution as if it were at equilibrium from start-up, it is not necessary to determine when the solution reaches equilibrium nor is it necessary to determine the concentration of by-products at equilibrium. Nonetheless, by material balance, it is possible to make these determinations. In this respect, following the analysis set forth by Cooke et al, Transactions of the Institute of Metal Finishing, 1975, volume 53, it is necessary to first consider pre-equilibrium conditions. To do so, let F equal the feed of a given constituent in the plating solution in grams per gram of metal plated, R the rate of consumption in grams per gram of metal plated and L the rate of liquid loss due to evaporation, withdrawal, drag-out and the like in liters per gram of metal plated. If W is the rate of metal plate-out in grams of metal plated and V the volume of the plating solution in liters, the rate of change in concentration C in grams at time t from start-up is expressed by the differential equation $$(dC)/(dt) = W/V(F-R-LC) \quad (1)$$

For supplemental components, for example complexing agents which do not take place in the reaction, R is O as there is no consumption build-up. For by-products, since by-products are not fed to the tank, F = O, but R is negative as by-products are not consumed, but formed. If the equation is integrated, the following relationship is obtained:

$$C = \frac{F-R}{L}[1 + \frac{LCo}{F-R} - 1)e^{-(\frac{LWt}{V})}] \quad (2)$$

As time approaches infinity, the solution approaches equilibrium and the concentration of a component at equilibrium is thus given by the expression $$C_e = (F-R)/L \quad (3)$$

Substituting the expression for equilibrium concentration in equation (2), we have the following relationship:

$$C = C_e[1 + (\frac{Co}{C_e} - 1)e^{-(\frac{LWt}{V})}] \quad (4)$$

If both sides of the equation are divided by $C_e$, the expression $$(\frac{C}{C_e} - 1) = (\frac{Co}{C_e} - 1)e^{-(\frac{LWt}{V})} \quad (5)$$

is obtained.

Taking the ratio, there is obtained the expression $$\frac{(C/C_e) - 1}{(Co/C_e) - 1} = e^{-(\frac{LWt}{V})} \quad (6)$$

Equation (4) and (6) can be used to determine equilibrium conditions though it should be understood that the determination is a mathematical approximation, not a precise description of that which occurs in the plating tank.

The following formulation is set forth for purposes of illustration:

| | | |
|---|---|---|
| Nickel sulphate hexahydrate | 24 | gm |
| Sodium hypophosphite monohydrate | 15 | gm |
| Sodium acetate | 15 | gm |
| Lead acetate | 0.02 | gm |
| Citric acid | 30 | gm |

-continued

| | | |
|---|---|---|
| Water | 1 | liter |
| pH | 4.5 | |

To determine equilibrium conditions, let the volume of an operating solution equal 1 liter and the withdrawal of solution constituents equal 14% per cycle (0.14 liters), the volume that would be removed if work-piece was being plated under conditions whereby the solution had an approximate life of 7 cycles absent the procedures for maintenance described herein. In actual practice, the solution would be withdrawn typically in four increments of 3.5% each over the course of a plating cycle, but for the purpose of the following calculations, withdrawal is treated as a single withdrawal during the plating cycle.

For determination of sulphate ion concentration at equilibrium using equation (3)

$$C_e = F-R/L.$$

From nickel sulfate, there are 1.64 grams of $SO_4$=per gram of $Ni^{++}$. Thus, F in the above equation is 1.64. In one cycle, 5.36 grams of $Ni^{++}$are plated and 14% of the liquid is removed for a liquid loss of 2.61% of the total solution volume per gram of nickel. Hence L equals 0.0261 liters. The sulfate is a supplemental component—it does not react during plating. Therefore, R=O. Accordingly, $$C_e = 1.64-0/0.0261$$

and the $SO_4$=concentration at equilibrium is 62.83 gm/1.

The number of cycles to reach equilibrium can be determined using equation (6) where $C/C_e$ is 0.9 in accordance with the definition for equilibrium. (If true equilibrium were sought, the number of cycles required to reach equilibrium would be infinite. Moreover, the change in the quality of the metal plate and solution performance between 90% of theoretical equilibrium and theoretical equilibrium is minimal.) In the original formulation, there were 8.77 gms of $SO_4$= *and hence* $C_o$ is 8.77. $C_e$ has been earlier determined to be 0.0261. Hence, for a liter solution:

$$\frac{0.9-1}{(8.77/62.83)-1} = e^{-\frac{0.0261W\cdot t}{1.00}}$$

$$W\cdot t = 82.46 \text{ grams of nickel}$$

As above, 1 cycle equals 5.36 grams of nickel plated. Therefore, sulfate will reach equilibrium (90% of theoretical) within 82.46/5.36 cycles or 15.38 cycles.

The same procedure can be used for phosphite determination though phosphite is a reaction product whereas sulfate is a supplemental component. For purposes of illustration only, assume that 1 mole of hypophosphite is oxidized to 1 mole of phosphite with no other by-products. In equilibrium equation (3), F equals 0 because phosphite is not fed into solution. From 15 grams of sodium hypophosphite monohydrate initially in solution, 9.20 grams are $H_2PO_2$—. This forms 11.32 grams of $HPO_3$—. Since there are 5.36 grams of nickel in a plating cycle, there are 2.11 grams of $HPO_3$— formed per gram of nickel. Hence R=2.11. L, as before, is 0.0261. Thus, $$C_e = 0-(2.11)/0.0261$$

and the equilibrium concentration of $HPO_3^-$ is 80.84 grams/liter.

To determine the number of cycles necessary to reach equilibrium, from equation (6), $C/C_e$ is 0.9, and the initial concentration of $HPO_3^-$ is 0. Thus, $Co/C_e$ is 0. Therefore, $$\left(\frac{0.9-1}{-1}\right) = e^{-\frac{0.0261(W\cdot t)}{1.00}}$$

$$W\cdot t = 88.22$$

Again, 1 cycle equals 5.36 grams of nickel and equilibrium will be reached in 88.25/5.36 or 16.40 cycles.

A cobalt plating solution that can be treated in the same manner as the aforesaid nickel plating solution is as follows:

| | |
|---|---|
| Cobalt sulfate heptahydrate | 32 gm |
| Sodium hypophosphite monohydrate | 9 gm |
| Ammonium sulfate | 56 gm |
| Sodium citrate | 90 gm |
| Water | to 1 liter |
| Temperature | 70° C. |

Other exemplary plating solutions that can be operated in accordance with the procedures of this invention are as follows:

| | |
|---|---|
| Potassium gold cyanide | 14 gm |
| Citric acid | 15 gm |
| N,N-diethyl glycine sodium salt | 4 gm |
| Pthalic acid monopotassium salt | 25 gm |
| Water | to 1 liter |
| Palladium chloride | 2 gm |
| Hydrochloric acid (38%) | 4 ml |
| Ammonium hydroxide (28%) | 160 ml |
| Ammonium chloride | 27 gm |
| Sodium hypophosphite monohydrate | 10 gm |
| Water | to 1 liter |

The following formulation is set forth for purposes of further illustration.

| | |
|---|---|
| Nickel chloride | 20 gm/liter |
| Dimethylamine borane | 3.5 gm/liter |
| Acetic acid (sodium salt) | 20 gm/liter |
| Ammonium hydroxide | to pH 8.5 |
| Water | to 1 liter |
| Temperature | 130° F. |

To determine equilibrium conditions for this solution, as in the previous example, let the volume of solution equal 1 liter, and the withdrawal of solution equal 20% of total volume per cycle. For the determination of chloride ion concentration at equilibrium $$C_e = F-R/L$$

From nickel chloride, there are 1.2 grams of Cl− per gram of nickel ion and F in the equation is 1.2. In one cycle, 9.07 grams of nickel ion are plated and 20% or 2.2% of the total solution volume per gram of nickel withdrawn. L therefore equals 0.022 liters. The chloride is a supplemental component—it does not react. Hence, R=O and $$C_e = 1.2-0/0.002$$

with chloride ion concentration at equilibrium equal to 54.5 gm/l.

The number of cycles to reach equilibrium is determined from equation (6) where again $C/C_e$ is 0.9 following the adopted definition of equilibrium. In the made-up formulation, there were 10.92 grams of chloride ion. Thus, $C_o$ is 10.92. $C_e$ is 54.5 and therefore, for a 1 liter solution, W·t is 94.52. Since 1 cycle equals 9.07 grams of nickel, chloride will reach equilibrium in about 10.4 cycles.

The above procedure is also used to determine equilibrium concentration for the dimethylamine reaction product. Making the assumption that 1 mole of dimethylamine borane yields 1 mole of dimethyl amine, in equilibrium equation (4), F=O. From 3.5 grams of dimethylamine borane, 2.7 grams of dimethylamine are formed or 0.29 grams per gram of nickel. Thus, R=−0.29. L, as before, is 0.022, hence, $$C_e = 0-(-0.29)/0.022$$

and the equilibrium concentration for the amine is 13.18 grams per liter.

To determine the number of cycles from equation (6), $C/C_e$ is 0.9, the initial concentration is O and $C_o/C_e$ is accordingly O. Therefore, $$\frac{0.9-1}{-1} = e^{-\frac{0.022W\cdot t}{1.00}}$$

and W·t = 104.7. Since 1 cycle equals 9.07 grams of nickel, equilibrium will be reached in 104.7/9.07 cycles or in 11.53 cycles.

It should be noted that for the above calculations, the plating solutions used were freshly made and were free of by-products at start-up.

However, there are alternatives to this procedure. For example, a plating solution could be used in conventional manner without withdrawing a portion of the solution to permit rapid growth of by-products. Thereafter, the solution can be operated in accordance with procedures of this invention to achieve equilibrium. In following this mode of operation, caution must be exercised to avoid the by-product concentration reaching an intolerable level.

Replenishment of plating solutions operated in accordance with this invention differs from replenishment procedures for solutions operated in accordance with the prior art. The difference is due to withdrawal of a portion of solution during each plating cycle which portion contains solution components. In the prior art, supplemental components are lost in small quantity by drag-out whereas reactants are lost both by drag-out and by reaction. In accordance with this invention, solution components are lost as a result of drag-out and reaction as in the prior art, but also by solution withdrawal. Hence the amount of each component in a replenisher composition per cycle is equal to the amount reacted (which is zero for supplemental components) plus an amount lost by drag-out plus an amount lost by withdrawal.

In a plating cycle, if replenishment were performed only at the termination of the cycle, the determination of a replenisher formulation would be simple following above guidelines. However, in practice, replenishment does not take place at the end of a plating cycle because, by definition, all of the nickel in solution would be depleted. As a consequence, no plating would occur and plating rate would decrease to an intolerably low level as the nickel concentration approached zero. Instead, in a plating cycle, replenishment occurs several times during the cycle, each addition of replenishment being made when the metal content is depleted to a predetermined level. This level can vary within relatively broad limits and typically, replenishment occurs when the nickel content is depleted by from 1 to 60% of its original content and more preferably, when the nickel is depleted by from 5 to 30 % of its original content. In accordance with this invention, there is also a withdrawal of plating solution prior to each replenishment. Thus, for example, if replenishment occurs 4 times per cycle, the withdrawal also occurs 4 times, each withdrawal conveniently, but not necessarily, being ¼ of the total amount withdrawn per cycle.

The number of incremental replenishments per cycle is dependent upon the extent of depletion when replenishers are added. In practice, the replenisher required for a plating cycle is divided into that number of portions necessary to bring the plating solution to its original composition from its depleted level each time the concentration reaches a predetermined level. For example, if the solution is depleted by 25% so that the metal content is 75% of its original content, replenishment of 25% of the total metal content is required to return the plating solution to full strength. Hence the replenisher is conveniently divided into 4 portions.

To determine the amount of each component in a replenisher formulation, as above, the concentration of such component is that amount necessary to replace that lost by reaction, drag-out and withdrawal. This can be determined by the following relationship.

$$C_R = R' + xC_w + yC_o \quad (7)$$

where $C_R$ is the concentration of the replenisher component in grams per cycle, R' is the amount of the component consumed by reaction in grams per cycle, x is the fraction of the total liquid withdrawn per cycle, $C_w$ is the concentration of the component at the time of withdrawal in grams and if there is more than one withdrawal per cycle, the concentration at the time of each withdrawal, y is the fraction of the total concentration of the component lost by drag-out and $C_o$ is the total initial concentration of the component in grams per cycle.

The addition of water to the plating solution has been discussed above. The amount of water added should be sufficient to maintain the volume of the plating solution essentially constant. Thus, water is added to replace that lost by evaporation and that withdrawn. As described above, the preferred procedure involves replacing that water lost by evaporation followed by solution withdrawal and replenishment.

The following examples will further illustrate replenishment both in accordance with the prior art (Formulation A) and in accordance with this invention (Formulation B).

Replenisher 1

For 1 liter of nickel-hypophosphite solution (supra) with withdrawal equal to 10% of total solution per plating cycle and replenishment made when nickel is depleted by 25%.

To determine the nickel sulfate concentration from equation (7), all of the nickel sulfate is consumed and its concentration is reduced from its original concentration of 24 grams to 0 in accordance with the definition of a cycle. Hence, R' is 24 grams. The fraction of the solution withdrawn per cycle is 10% or 0.1 parts of the total solution. Hence x is 0.1. The concentration of nickel sulfate at the time of each withdrawal —Cw— is 18 grams as the original concentration of 24 grams is reduced by 25% when replenishment occurs. Drag-out over a plating cycle comprises about 2% of the initial concentration and hence, y is 0.02. $C_o$ is 24 grams per cycle. From equation (7).

$$C_R = 24 + 0.1(18) + 0.02(24)$$

and the amount of nickel sulfate in the replenisher is then 26..28 grams per cycle. In comparison, the amount required for replenishment in accordance with the prior art would be 24.48 grams.

The determination of sodium hypophosphite replenishment is quite similar to that for nickel sulfate. Assuming that the sodium hypophosphite is consumed at the same rate as the nickel sulfate in the reaction per cycle, $$C_R = 15 + 0.1(11.25) + 0.02(15)$$

and the replenisher should contain 16.5 grams of sodium hypophosphite monohydrate. This would compare to 15.3 grams following prior art procedure.

For a supplemental component, citric acid for example, R' of equation (7) would be 0 and the amount of acid in the replenisher would equal $$C_R = 0 + 0.1(30) + 0.20(30)$$

or 3.60 grams.

The total replenisher composition for this example is as set forth in the following table where Formulation A is a replenisher for a prior art operation and Formulation B is for the procedures set forth herein.

| | Formulation A | Formulation B |
|---|---|---|
| Nickel sulfate hexahydrate gm | 24.48 | 26.28 |
| Sodium hypophosphite monohydrate gm | 15.30 | 16.60 |
| Sodium acetate gm | 0.30 | 1.80 |
| Lead acetate gm | 0.0004 | 0.0024 |
| Citric acid gm | 0.60 | 3.60 |
| Ammonium hydroxide | to pH 4.5 to 5.0 | |

The above Formulation B may be added in dry form but preferably is added as a solution. For convenience, the formulations may be dissolved in an amount of water equal to the volume of solution withdrawn. in this example, for 1 liter of solution, the total volume of liquid withdrawn per cycle is 100 ml withdrawn in 4 equal increments of 25 ml each at each point in the cycle where the nickel solution is depleted by 25%. For replenishment, the solution would be divided into 4 equal portions and added following each of withdrawals of solution.

Replenisher 2

For 1 liter of nickel/hypophosphite solution (supra) with withdrawal equal to 15% of solution per plating cycle and replenishment made where nickel is depleted by 33%.

| | Formulation A | Formulation |
|---|---|---|
| Nickel sulfate hexahydrate gm | 24.48 | 26.88 |
| Sodium hypophosphite monohydrate gm | 15.30 | 16.80 |
| Sodium acetate gm | 0.30 | 2.55 |
| Lead acetate gm | 0.0004 | 0.0034 |
| Citric acid gm | 0.60 | 5.1 |
| Ammonium hydroxide | to pH 4.5 to 5.0 | |

As to addition of the replenisher formulation, the same considerations apply as set forth for replenisher 1. Note that the replenisher is subdivided into three portions.

Replenisher 3

For 1 liter of nickel/borane solution (supra) with withdrawal equal to 20% solution per plating cycle and replenishment made when nickel is depleted by 20%.

| | Formulation A | Formulation B |
|---|---|---|
| Nickel chloride gm | 30.60 | 35.40 |
| Dimethylamine borane gm | 3.57 | 4.27 |
| Sodium acetate gm | 0.60 | 3.80 |
| Ammonium hydroxide* | | |

*added separately to maintain bath pH of about 8.5

The above Formulation B is added in 200 ml of water divided into 5 equal portions of 40 ml each.

Replenisher 4

For 1 liter of the cobalt solution (supra) with withdrawal equal to 25% of solution per plating cycle and replenishment made when cobalt is depleted by 1/6 of its initial concentration.

| | Formulation A | Formulation B |
|---|---|---|
| Cobalt sulfate heptahydrate gm | 30.6 | 35.1 |
| Sodium hypophosphite monohydrate gm | 9.2 | 10.5 |
| Ammonium sulfate gm | 1.0 | 8.5 |
| Sodium citrate gm | 1.8 | 15.3 |

The above replenisher may, if desired, be dissolved in 250 ml of water or the various ingredients of the replenisher may be added as separate additions to the plating solution.

It should be understood that replenisher components need not be the same throughout operation of the bath. For example, it may be desired that the surface layer of a metal coat differ from the underneath portion of the coat, the reverse may be desired, or a multilayered, structure may be desired. For example, it is known from U.S. Pat. No. 3,832,168 (incorporated herein by reference) that the properties of nickel plated from a plating solution containing copper ions in an amount of about ½ percent of the total metal ions differs from properties obtained from a solution free of such ions as the copper ions, particularly cuprous ions, improve the appearance, corrosion resistance and ductility of the nickel plate. Thus, a source of copper ions can be added to the plating solution in the initial, intermediate, or final stages of plating for a more corrosion resistant base, intermediate layer, or an improved surface finish. Because of plate-out of the copper and frequent withdrawal of solution, the solution will contain sufficient copper to effect the desired properties, but will become rapidly depleted in copper so as not to effect subsequent deposit. A variety of laminar structures can thus be formed.

To illustrate the foregoing, using the nickel-hypophosphite solution supra, a part is plated in conventional manner, the solution being replenished with Formulation B of replenisher 1, there being 4 replenishments in the plating cycle. As aforesaid, Formulation B is subdivided into 4 equal parts. To obtain an alloy coat, the replenisher formulation for the fourth replenishment would have a composition as follows:

| | |
|---|---|
| Nickel sulfate hexahydrate gm | 6.57 |
| Cuprous chloride gm | .05 |
| Sodium hypophosphite monohydrate gm | 4.12 |
| Sodium acetate gm | .45 |
| Lead acetate gm | 0.0006 |
| Citric acid gm | 0.4 |
| Ammonium hydroxide | to pH 4.5 to 5.0 |
| Water | 25 ml |

The above will give a nickel-copper topcoat to the part if it is removed from solution at the end of the plating cycle.

A multilayered structure is particularly desirable in the plating of magnetic recording surfaces such as those taught in U.S. Pat. No. 3,531,322 incorporated herein by reference. Thus combinations of non-magnetic and magnetic properties are obtained by varying the amount of cobalt is a nickel/cobalt alloy deposit (see Example 1 of U.S. Pat. No. 3,531,322). In the prior art, it was necessary to transfer the part to successive plating solutions to obtain the desired layered structure. In accordance with this invention, the layered structure may be obtained by adding cobalt to the replenisher formulation of parts within the plating sequence so as to obtain the alloy desired.

In the formation of a multilayered structure as above, there is an advantage in addition to elimination of more than one plating tank. When transferring a part from one tank to another, deactivation of the plated surface during transfer occurs. For example, with reference to the aforesaid nickel-copper alloy top layer, to achieve the same using prior art procedures, a nickel layer cannot be deposited with the part then transferred to a separate solution for the alloy top layer. Instead, upon exposure of the nickel-coaed part to air, it becomes deactivated and must be reactivated such as by a hydrochloric acid dip and water rinse prior to immersion in the second tank containing the alloy plating solution.

Other alloying constituents that can be added to the plating solutions that are the subject of this invention include tungsten, rhenium, berylium, rhodium, palladium platinum, tin, zinc, molybdenum and gold to provide alloys as taught in U.S. Pat. No. 3,485,597 which patent is incorporated herein by reference. In each case, to form the alloy desired, typically but not necessarily as the top surface of the plate, the alloying constituent is added in one or more of the replenishments at the desired point in the plating of a part.

Another major advantage of the invention described herein is in the plating of aluminum with a nickel hypophosphite plating bath. It is known that aluminum dissolves in the metal plating solution and when its concentration is sufficiently high, such as by the third plating cycle, the metal deposited over the aluminum blisters and peels from the substrate. It is also believed that the oxidation product of the hypophosphite is an inhibitor and prevents the dissolution of aluminum when it is present in sufficiently high concentration, but not so high a concentration as to contaminate the bath such that it is no longer functional. In the prior art, the aluminum build-up in solution was such that its concentration caused blistering before the hypophosphite reaction product concentration was sufficiently high to inhibit aluminum dissolution. In accordance with this invention, the dissolved aluminum concentration can be maintained relatively low as it is continuously withdrawn, and through equation (3) above, the concentration of the reaction product of the hypophosphite can be adjusted to a level whereby it is sufficiently high to inhibit aluminum dissolution but is not so high as to adversely affect the properties of the bath.

We claim:

1. A replenisher composition for an electroless metal plating solution having evaporative losses of at least 1% per plating cycle in use and containing metal ions, a reducing agent for said metal ions and a complexing agent for said metal ions, said replenisher composition comprising at least two components separately or in admixture, said components being selected from the group of a source of the metal plating ions, a reducing agent, a complexing agent to maintain said ions in solution and a pH adjuster, said components being in a concentration by weight equal to about the amount of the component reacted in the plating solution per plating cycle plus an amount lost by drag-out plus an excess amount, said excess amount being from one one-hundredth to 60 one-hundredths by weight of the amount of the component originally present in said plating solution.

2. The replenisher composition of claim 1 where the excess is from 5 to 25 one-hundredths of the original amount.

3. The replenisher composition of claim 1 where the plating solution is a nickel-hypophosphite solution and the replenisher contains at least a nickel salt and a hypophosphite salt.

4. The replenisher composition of claim 1 where the plating solution is a nickel borane solution and the replenisher contains at least a nickel salt and an amine borane reducing agent.

5. The replenisher composition of claim 1 additionally containing a source of metal ions differing from the metal ions of the plating solution.

6. The replenisher composition of claim 5 where the additional metal ions are copper ions.

7. The replenisher composition of claim 5 where the additional metal ions are cuprous ions.

8. The replenisher composition of claim 5 where the additional ions are cobalt ions.

9. The replenisher composition of claim 1 in aqueous solution.

* * * * *